United States Patent [19]

Omansky

[11] 4,161,089

[45] Jul. 17, 1979

[54] MODULAR BUILDING STRUCTURE SYSTEM

[76] Inventor: Martin B. Omansky, 10702 Green Mountain Cir., Columbia, Md. 21044

[21] Appl. No.: 860,386

[22] Filed: Dec. 14, 1977

[51] Int. Cl.[2] ..... E04C 3/10

[52] U.S. Cl. ..... 52/227; 52/262; 52/274; 52/403; 52/585; 52/586; 273/95 H

[58] Field of Search ..... 52/227, 234, 262, 274, 52/293, 403, 585, 586, 594, 584, 582; 273/95 H

[56] References Cited

U.S. PATENT DOCUMENTS

| | | | |
|---|---|---|---|
| 498,344 | 5/1893 | Williams | 52/403 |
| 1,421,124 | 6/1922 | Brandt | 52/262 |
| 2,438,140 | 3/1948 | Auten | 52/497 X |
| 2,521,381 | 9/1950 | Linck | 52/262 |
| 2,803,856 | 8/1957 | Kofahl et al. | 52/227 |
| 2,862,255 | 12/1958 | Nelson | 52/403 |
| 3,246,435 | 4/1966 | Russell | 52/584 |
| 3,256,652 | 6/1966 | Van Der Lely | 52/234 |
| 3,343,314 | 9/1967 | Smith | 52/262 |
| 3,399,859 | 9/1968 | Bowden et al. | 52/403 |
| 4,068,840 | 1/1978 | Spaulding, Jr. | 273/95 H |

*Primary Examiner*—Alfred C. Perham

*Attorney, Agent, or Firm*—Morton J. Rosenberg

[57] ABSTRACT

A modular building structure system for optimally minimizing construction as well as demounting time for the structure system. The structure system is particularly adaptable to structures which endure large dynamic impact loading. The structure system is mainly formed of panelized members which are covered with interior and possibly exterior surfacing formed in a prefabricated manner in order to provide a completely finished panel member acceptable for placement in a predetermined location within the system. Wall panel members of the modular building structure system are load bearing structures and provide a bearing structure for ceiling panel members mounted directly on the wall panels. The wall panel module members are inserted in channels which are mounted to a foundation upon which the structure is built. The wall panel module members are positionally located in abutting relation each with respect to a next successive wall panel module member, and mounted each to the other through tension rods and frictionally interfitting slip pin members. Ceiling or roof panel module members are secured to upper surfaces of the wall panel modules to provide a complete structure system.

22 Claims, 7 Drawing Figures

FIG. 7
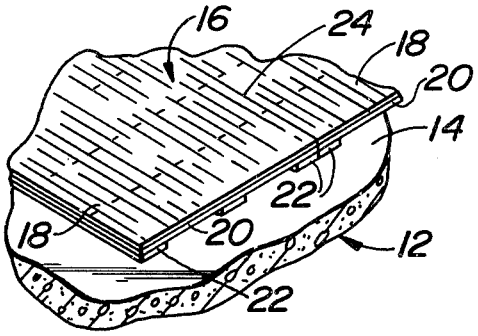
FIG. 1
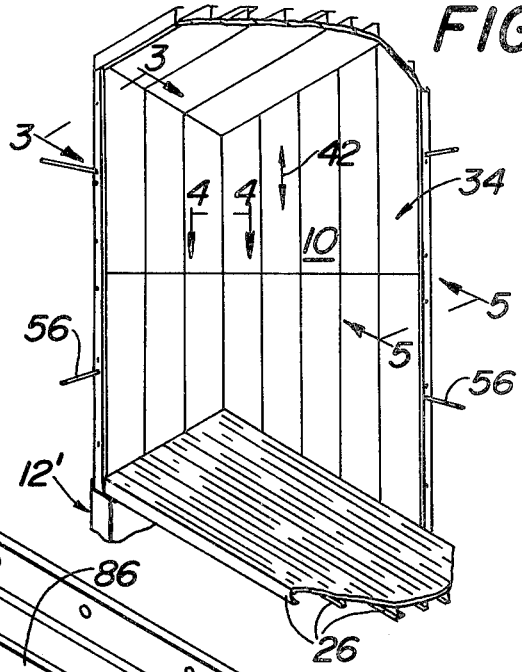
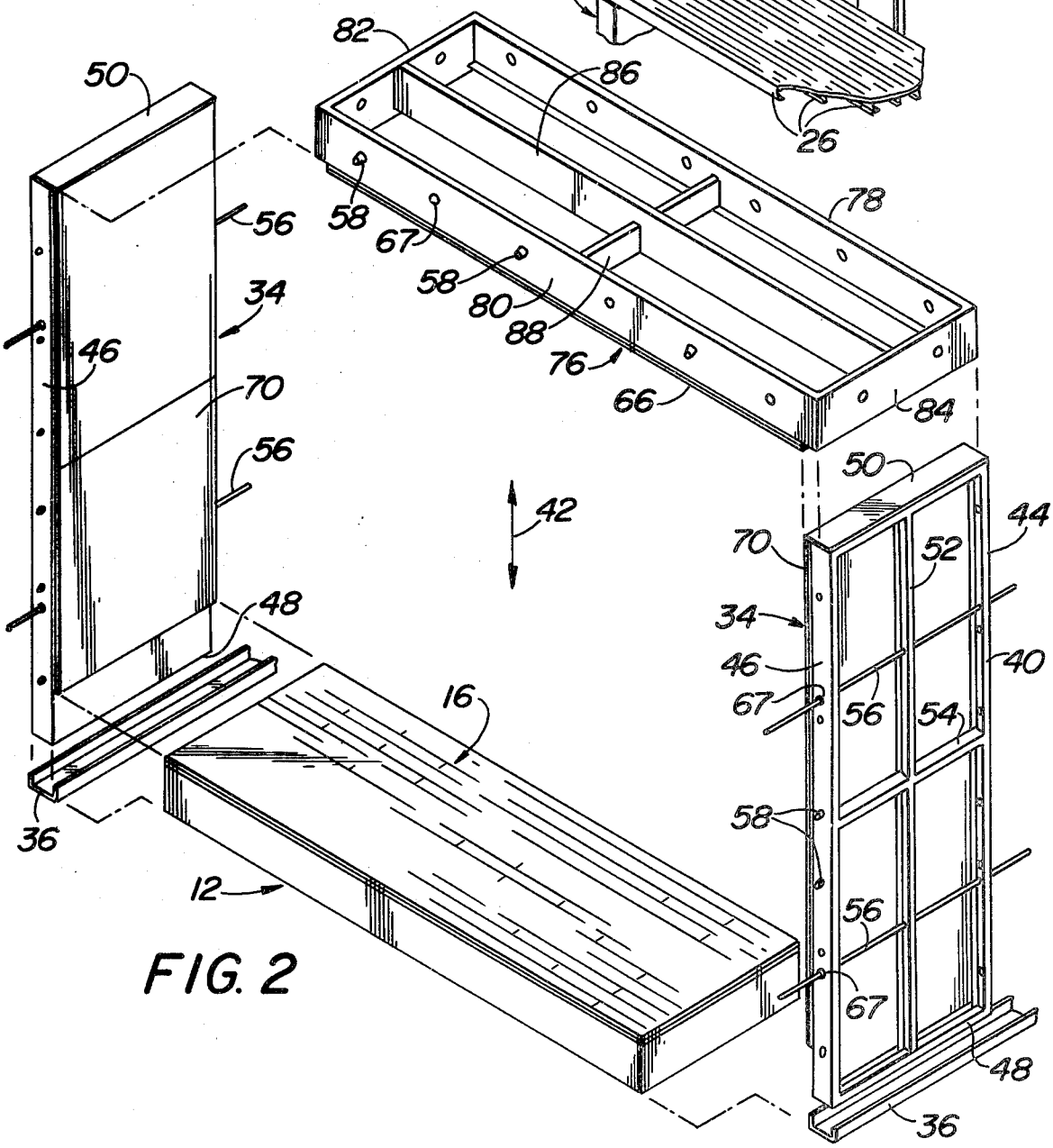
FIG. 2

90
98
100
92
76
50
68
66
70
66
40
70
72
74
68
34
32
16
18
20
38
30
28
26
36
48
12'

44
46
62
58
64
60

FIG. 4
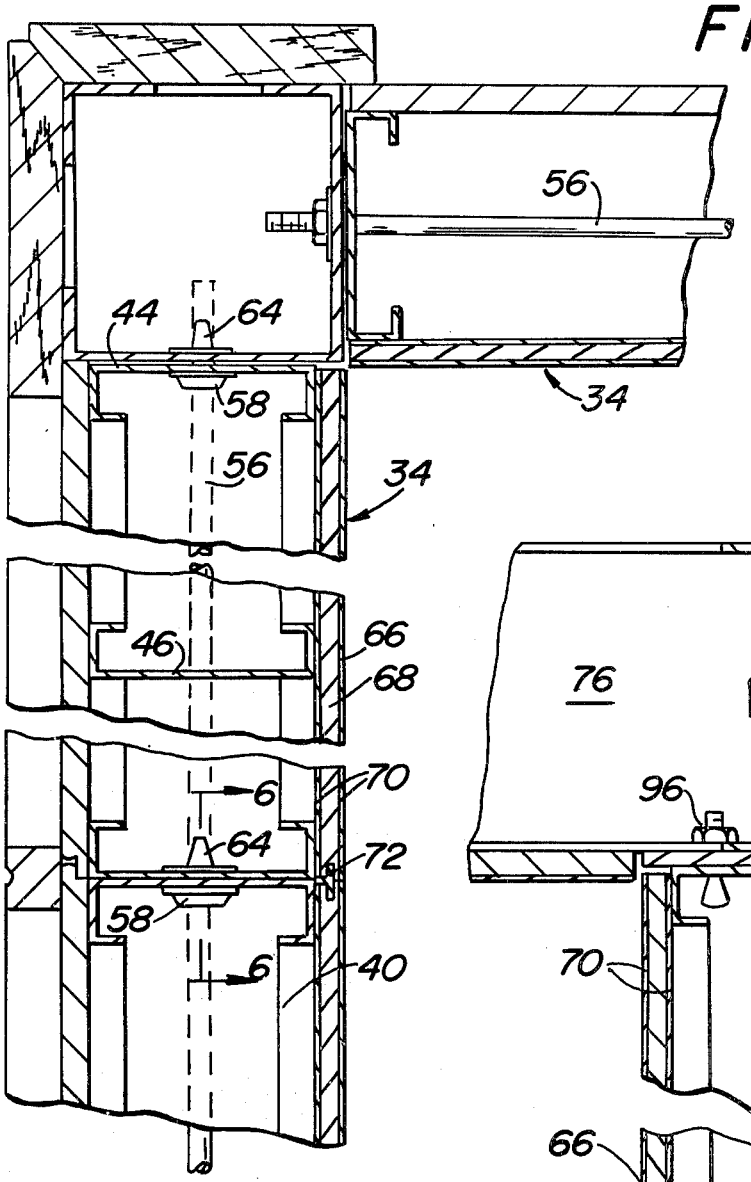
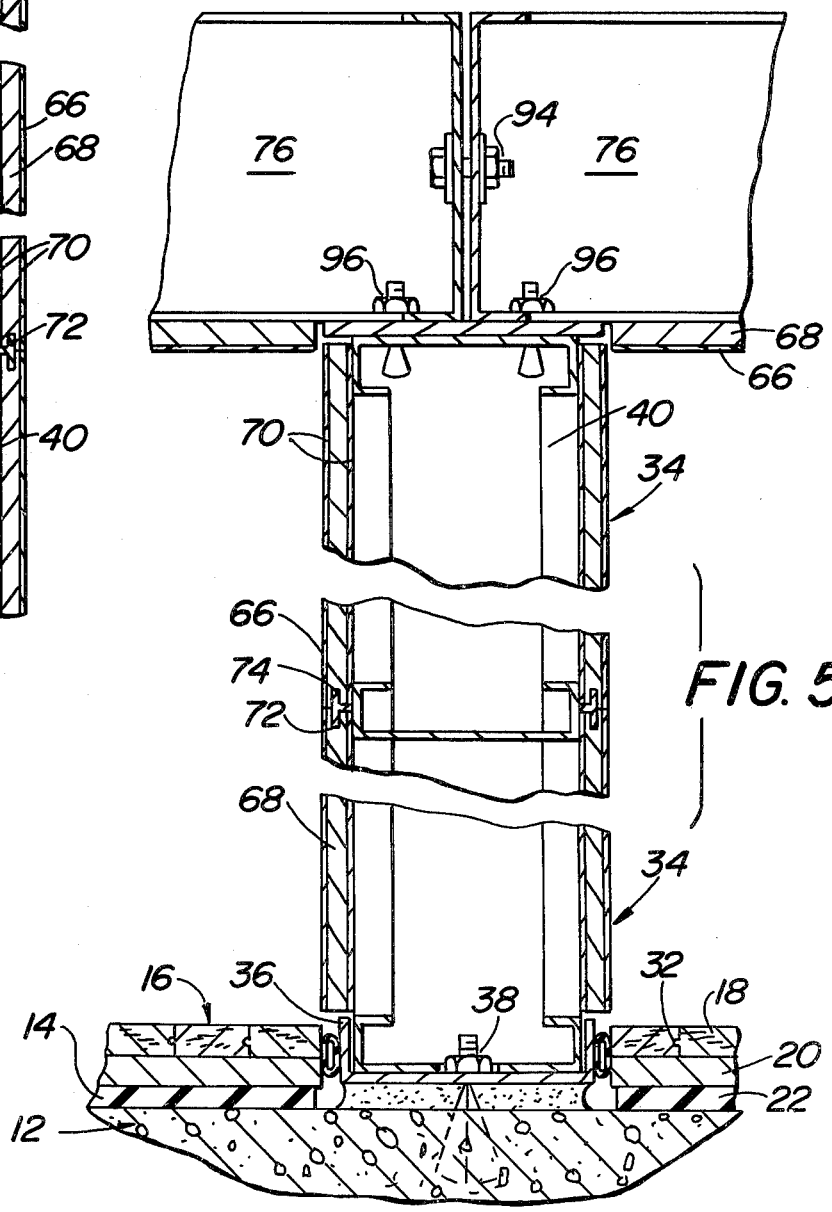
FIG. 5

MODULAR BUILDING STRUCTURE SYSTEM

BACKGROUND OF THE INVENTION

1. Field of the Invention

This invention pertains to building structures. In particular, this invention relates to modular building structure systems. Still further, this invention pertains to panelized building structure systems where the panel members are load bearing. More in particular, this invention relates to modular building structure systems formed of a plurality of panel modules which are prefabricated. More in particular, this invention pertains to building structure systems substantially devised of columns or frame work to which panels would be secured. Still further, this invention relates to modular building structure systems where the panelized modules are constructed to structurally absorb high impact loads.

2. Prior Art

Modular building structure systems are well-known in the art. However, modular systems particularly adaptable to racquet ball or handball courts has not heretofore been utilized in the building construction art. In general, these types of structures must be adapted to take high impact loading and panelized modules have not been previously designed to accept such stresses.

In the building of prior art handball or racquet ball courts, building contractors would generally form a masonry structure and then apply plaster or some like material in small sections. This had the effect of increasing construction labor costs as well as material costs in the erection of such overall masonry structure walls directed to this type of prior art system structure.

In some prior art systems, a steel frame was erected adjacent and attached to cinder or cement block walls. Plastic panels would then be affixed manually to the steel frame. This had the effect of expending great amounts of labor time, as well as incorporating a number of trade skills which increase the time of construction.

In such prior structure systems, the structure housings could not be demounted from the installation base and reconstructed in a displaced area without the loss of considerable time. Additionally, such demounting in prior art systems caused a complete destruction of the structure systems, thus resulting in increased cost should the system be moved to another remote site for construction.

Additionally, where the prior art building systems were constructed without utilization of panelized modules, such systems had to be constructed as a total system housing. Such prior cement block and plaster systems were not able to be incorporated in existing buildings, thus further increasing the costs of such systems. Such systems increased construction time and were not relocatable. In any event, such prior systems were not adapted to prefabricability.

Prior systems required substantially skilled labor to acquire necessary tolerance restrictions particularly for such handball and racquet ball courts which further increased the overall costs of such systems.

BRIEF DESCRIPTION OF THE DRAWINGS

FIG. 1 is a perspective view of a section of the modular building structure system;

FIG. 2 is a perspective partially exploded view of floor panel members, ceiling panel members, and wall panel members of the modular building structure system;

FIG. 4 is a sectional elevation view partially cut away taken along the section line 4—4 of FIG. 1 showing a corner section of the modular building structure system;

FIG. 5 is a sectional view of a common wall panel member taken along the section line 5—5 of FIG. 1;

SUMMARY OF THE INVENTION

Figures 3, 6:
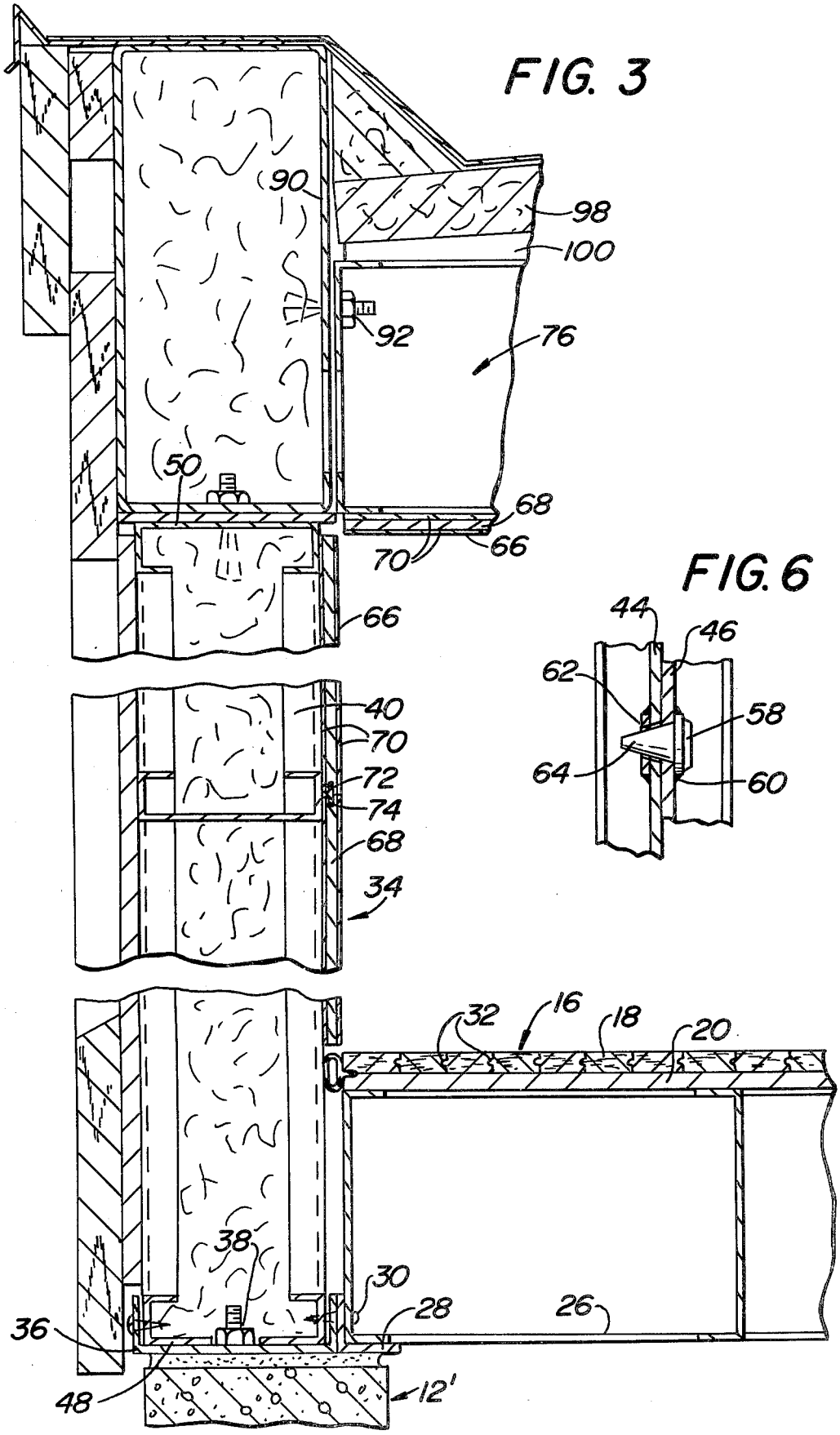
FIG. 3 is a sectional view of a wall panel member taken along the section line 3—3 of FIG. 1.
FIG. 6 is an elevation view of a slip pin member holding two joining wall panel members; and, FIG. 7 is a partial perspective view of a floor panel member on a foundation base.

A modular building structure which includes a foundation member having an upper surface defining a base plane. Channel members are secured to the foundation members and a plurality of wall panel members are slidably insertable within the channel members. The wall panel members extend in a plane substantially orthogonal to the base plane defined by the upper surface of the foundation member. Each of the wall panel members are positionally located in abutting relation to a next successive wall panel member. A plurality of ceiling panel members are secured to the wall panel members on an upper surface thereof and the ceiling panel members extend substantially in a plane parallel to the base plane.

DESCRIPTION OF THE PREFERRED EMBODIMENTS

Referring now to FIGS. 1–7, there is shown modular building structure system 10 and associated components for providing a substantially pre-fabricated building adapted for use in various sporting facility applications. In particular, modular building structure system 10 may be used in the building of handball and racquet ball courts, or other like sporting structures. System 10 is particularly adaptable, but not solely utilizable for structure systems which may take high stress loading whether dynamic or static, on the various components making up modular building structure system 10. As will be seen in following paragraphs, system 10 provides a substantially panelized concept which includes a system of freestanding steel frames that provide support for the frames themselves as well as the roof or ceiling members so that the panelized system provides its own structural support. Individual panels are constructed of steel studs which have mounted thereto interior and exterior surfaces which are prefabricated in one completely finished panel ready for insert into its proper place within the overall modular building structure system 10. As will be seen, system 10 allows for the vitiation of the general prior art building sub-system or steel skeleton upon which prior art buildings of this type have been built upon.

Referring now to FIG. 7, modular building structure system 10 is seen to be mounted on foundation member 12 having upper surface 14 defining a base plane. Upper surface 14 is generally formed in the horizontal plane for levelling purposes. For purposes of discussion, foundation member 12 as shown in FIGS. 2, 5 and 7, may be formed of a concrete slab extending throughout the overall horizontal peripheral contour of system 10. Of course, it is to be realized, that the foundation as is herein generally discussed, may be in the form of concrete columns 12', as is shown in FIGS. 1 and 3.

Whether the foundation includes a concrete foundation member 12, or wall-like foundation members 12', the basic concepts of construction for system 10 are similar in nature.

Referring to foundation member 12, as shown in FIG. 7, member 12 is generally treated with skim coats of concrete which are well-known in the art, and are generally finished to a high degree of accuracy to provide a smooth surface which is adaptable to be levelled in a particular plane of interest. Foundation member 12 is generally formed into a monolithic slab member possibly having expansion joints set therein, however, such is not important to the inventive concept as is herein described and detailed.

Referring once again to FIGS. 2, 5, and 7, floor system 16 is positionally located on foundation member 12, and extends in the horizontal or base plane defined by the plane of upper surface 14. Floor system 16 includes a plurality of floor panel members 18 and 20 mounted in contiguous relation each to the next. Floor panel interior planar member 18 may be formed of a hardwood such as maple, oak, or some like wood composition. Additionally, member 18 may be formed of other compositions not important to the inventive concept as herein detailed, with the exception that such compositions be capable of taking the stresses applied. Floor panel sub-surface planar member 20 is secured to floor panel interior planar member 18 throughout the interfacing plane of contact. As can be seen in FIG. 7, floor system 16 may be formed of a plurality of panel members 18 and 20 each constructed by itself and laid adjacent to a next set of floor panel members 18 and 20. This is clearly seen by interface boundary line 24 showing the mounting of one set of floor panel members 18 and 20 mounted in side by side relation with a next set of floor panel members 18 and 20. Floor panel sub-surface planar members 20 may be formed of plywood, or some like wood construction.

Additionally, gasket members 22 may be secured to floor panel sub-surface planar members 20 to be sandwiched between members 20 and foundation member 12 as is seen in FIG. 7. Gasket members 22 are generally resilient in nature, and may be formed of neoprene or rubber, or some like composition not important to the inventive concept with the exception that gaskets 22 provide resiliency for floor system 16, and to maintain system 16 in a generally stationary positional location on foundation member 12 to minimize any slipping conditional state.

In the embodiment shown in FIGS. 1 and 3, floor system 16 is mounted on foundation wall-like member 12' through floor steel studs 26. Floor panel sub-surface planar member 20 is secured directly to floor steel studs 26 as is shown in FIG. 3, and floor panel interior members 18 are interfaced with an upper surface of planar members 20 as has hereinbefore been described. Securement of steel studs 26 to foundation member 12' may be through a number of techniques, one of which is clearly seen in FIG. 3, where floor angle iron member 28 interfaces and matingly engages a lower corner of steel stud 26, and floor screw or bolt 30 secures stud 26 to angle iron member 28 for ultimate securement purposes to foundation member 12'.

In both types of floor system construction, floor panel interior planar members 18 are generally mounted by tongue-in-groove methods as represented by numeral 32 to provide a secure fit for the sub-members of interior planar member 18. Although dimensionally not important to the inventive concept as is herein described, plywood sub-surface planar member 20 may be approximately ¾" thick, and floor panel interior planar members 18 are approximately 25/32" thick to provide the necessary structural load bearing requirements of modular building structure 10. Thus, in overall concept, the floor base system is formed of a tri-layer set of components, including foundation member 12 or 12', a plywood sub-surface planar member 20 sandwiched between floor panel interior hardwood members 18 and resilient gaskets 22, all formed into a substantially unitary structure to provide a stationary base for modular building structure system 10.

Referring now to FIGS. 1–6, there is shown a number of wall panel members 34, which are slidably insertable within channel members 36. Channel members 36 are generally placed or positionally located around the periphery of the internal volume of structure system 10, and provides a guide within which wall panel members 34 may be inserted. Additionally, channel members 36 are secured to foundation members 12 or 12' through levelling bolts 38 or some like securement mechanism to provide wall panel members 34 in a substantially extending plane orthogonal to base plane defined by upper surface 14 of foundation 12 or 12'. Levelling bolts 38 are generally well-known in the art, and allow positional location of wall panel members 34 in abutting relation each with respect to a next successive wall panel member 34 to maintain alignment in a vertical dimension.

The total wall panel members 34 include wall panel frame members 40, which are substantially rectangular in contour, and as is seen in FIG. 2, are adapted for slidable insert into channel members 36 around the periphery of the internal volume of building structure system 10. In overall dimension, wall panel frame members 40 are approximately 4' in width, and 20' 6" in height, measured in the vertical direction as is defined by vertically directed arrow 42. Wall panel frame members 40 are formed in a unitary manner through welding and utilizes steel studs for construction purposes. As will be seen in following paragraphs, wall panel frame members 40 are formed in particular structural contour for withstanding stress loads that are generally unique to the construction of racquet ball and handball or other like court systems. It is to be understood that wall panel members 34 of the present invention concept, must structurally withstand high dynamic force load impacts resulting from users hitting ball-like objects at great speeds, thus, wall panel members 34 must withstand larger impact loadings than prior art wall systems.

Wall panel frame members 40 include a pair of opposing side wall panel frame members 44 and 46 which extend in a substantially orthogonal direction to the horizontal or base plane. Additionally, a pair of opposing base wall panel frame members 48 and 50 are secured to side wall panel frame members 44 and 46. As can be seen, lower base wall panel frame member 48 is slidably insertable within channel members 36 for construction purposes. Side wall panel frame members 44 and 46, and base wall panel frame members 48 and 50, are unitarily welded each to the other to provide the overall contour clearly seen in FIG. 2.

Wall panel frame member 40 further includes vertical support member 52, extending in vertical direction 42 and being secured on opposing ends thereof to opposing base wall panel frame members 50 and 48. Vertical support member 52 is generally positionally located substantially central to the displacement dimension of opposing side wall frame members 44 and 46. Vertical support member 52 may be welded or otherwise constructed in unitary fashion with opposing base wall panel frame members 48 and 50. Also included in wall panel frame member 40, is horizontal support member 54 which is secured to vertical support 52 as well as opposing side wall panel frame members 44 and 46. Horizontal support member 54 extends in a direction substantially normal to vertical direction 42, and is positionally located substantially central to the vertical displacement distance between base wall panel frame members 50 and 52. As was the case with the vertical support member 52, horizontal support member 54 is welded or otherwise unitarily constructed with opposing side wall panel frame members 46 and 48, as well as vertical support member 52.

Both of the vertical support members 52, and the horizontal support members 54 associated with each wall panel frame member 40, is provided to maximize the stress capability of each of wall panel members 34. Horizontal support members 54 are utilized in particular to prevent the overall wall panel members 34 from racking or torsionally twisting out of the predetermined contour during the shipment phase and/or erection of modular building structure system 10. Additionally, supporting members 52 and 54 provide additional surface area in order that the interior laminate, to be further discussed in following paragraphs, with additional surface area for attachment thereof.

Mounting of one wall panel member 34 to a next successive wall panel member 34 is accomplished through a combination of tension rods 56 and slip pins 58. Initially, one panel member 34 is slidably inserted into a corresponding channel 36. Conically shaped slip pin members 58 clearly seen in FIG. 6, extend from one side wall panel frame member 46. Slip pin members 58 are welded as shown at 60, or otherwise constructed to extend laterally from side wall panel frame members 46. Correspondingly, an adjacently placed side wall panel frame member 44 includes a tapered recess opening 62 for insert of slip pin member 58. Tapered opening 62 is dimensioned to provide a friction fit for conical extension section 64 of slip pin member 58. Thus, there is provided a tight friction fit between side wall panel frame member 44 of one panel member 34, and an adjacently positioned and contiguous side wall panel frame member 44 of a next wall panel member 34. This friction fit type of mounting allows for alignment between consecutively placed wall panel members 34 and further provides for some rigid stability of a series of panel members 34. Further, tension rods 56 are inserted through tension rod openings 67, provided on opposing side wall panel frame members 44 and 46 as well as through vertical support members 52 to increase the structural stability of the overall system, once constructed. The use of slip pin members 58 has been found to optimize the time of alignment and positional placement of wall panel members 34 in constructing the interior walls of modular building structure system 10.

Interior wall panel member 66 is secured in rigid manner to wall panel frame members 40 to provide a continuous inner wall of modular building structure system 10. Interior wall panel members 66 include planar wood member 68 which may be formed of particle board or other like material, not important to the inventive concept as is herein described with the exception that it take the high impact loads associated with the use of building structure system 10. Planar wood member 68 has mounted on opposing sides thereof, a plastic laminate material forming plastic planar members 70 clearly seen in FIG. 3. Plastic planar members 70 are secured to planar wood member 68 through adhesive attachment such as glue or some like panel adhesive. Additionally, interior wall panel member 66 is mounted to side wall panel frame members 44 and 46 as well as base wall panel frame members 48 and 50 and support members 52 and 54 through adhesive securement. Plastic laminate sandwich members forming interior wall panel member 66 is glued to wall frame members 40, one type of adhesive utilized is an industrial grade construction glue, commonly referred to as Peel 400.

In general, interior wall panel member 66 may generally be mounted to wall panel frame members 40 by means of a mechanical securement of an anchor and a threaded securement through one of the wall panel frame members 40 into particle board or planar wood member 68. As can be clearly seen in FIG. 5, where wall panel members 34 are utilized for common walls between two rooms or courts, there is no access to interior wall panel member 66 once wall panel members 34 are constructed. In this case, it is obvious that adhesive securement is the main bond of interior wall panel members 66 to wall panel frame members 40.

As is seen in FIGS. 3, 4 and 5, there is included metal spline member 72 which is insertable within groove 74 formed within a peripheral surface of planar wood member 68 for securement of interior wall panel member 66 to wall panel frame member 40. Spline 72 is T-shaped and designed to fit into groove 74 for appropriate spacing of wall panel members 34 in order to minimize the seam resulting between two adjacently spaced wall panel members 34. Spline member 72 may be formed of aluminum, or some like metal not important to the inventive concept as is herein described.

As has hereinbefore been stated and disclosed, tension rods 56 may be used for joining adjacently mounted wall panel members 34 each to the other. However, steel strapping may be substituted for tension rods 56 during the construction mode of operation for modular building structure system 10. Steel strapping, which has a high tensile load capability, is formed in coils and includes an extended steel rod member at an initiation point of the coil. The rod may be placed through appropriate tension rod openings 67 through an appropriate number of wall panel members 34. This has the effect of utilizing coils of tension members instead of transporting and otherwise delivering long steel rods onto the construction site, and then passing them through the appropriate tension rod openings 67.

Modular building structure system 10 further includes ceiling panel members 76 which in general are secured to wall panel members 34 on an upper surface thereof. Ceiling panel members 76 are positionally located and extend substantially in a plane parallel to the base plane defined by upper surface 14 of foundation member 12 or 12'. In general, ceiling panel members 76 are formed in the same manner and mode as wall panel members 34. However, wall panel frame members 40 generally include 6" stud members whereas ceiling panel members are formed in 8" steel joists. Ceiling panel members 76 are formed of opposing ceiling side wall panel frame members 78 and 80, and opposing base ceiling frame members 82 and 84, all welded together or otherwise unitarily formed in the same manner as wall panel frame members 40. As was the case with wall panel members 34 and associated wall panel frame members 40, ceiling panel members 76 include support members 86 and 88 passing in the same direction relative to the base panels 82 and 84 and the side panel frame members 78 and 80, as was provided for support members 52 and 54 for wall panel frame members 40.

As is clearly seen in FIGS. 3 and 5, interior wall panel members 66 formed by planar wood member 68 sandwiched between plastic planar members 70, is secured to frame members 78, 80, 84, 86 and 88. As seen in FIG. 3, ceiling panel members 76 may be joined to structural angle iron 90 through bolts 92 or some like mechanical securement not important to the inventive concept as is herein described. In FIG. 5, ceiling panel members 76 are joined each to the other and to a centrally disposed wall panel frame member 40 through ceiling bolts 94 and 96. In this case, it is seen that wall panel member 34 is a common ball between two separate rooms in a court structure. In the case of ceiling panel members, there is still provided slip pins 58 formed external to ceiling side panel frame member 80 for the same purposes as has been discussed in previous paragraphs for wall panel members 34. Additionally, tension rods may be inserted through tension rod openings 67 for maintaining ceiling panel member 76 in tension aligned displacement each with respect to the other.

Although not important to the inventive concept, modular building structure system 10 may include as is shown in FIG. 3, rigid insulation decking 98 which may be formed of 3" tectum or some like material and dimensional thickness. Insulation decking 98 may be applied to sleepers 100 which are formed on ceiling frame members 80, 82, 84 and 78. Sleepers 100 are tapered in generally continuous manner, in order that the low point would be a water drain for system 10.

It is to be understood that these and other modifications may be resorted to without departing from the spirit or scope of the invention. Equivalent elemental structures may be substituted for those specifically shown and described, certain features may be used independently of other features, and in some cases, portions may be reversed, all without departing from the spirit or scope of the invention. It is to be understood that the invention is therefore only limited by the claims appended hereto.

What is claimed is:

1. A modular building structure comprising:

(a) a foundation member having an upper surface defining a base plane;

(b) at least one channel member formed in one piece formation secured to said foundation member;

(c) a plurality of wall panel members slidably insertable within said channel member, said wall panel members extending in a plane substantially orthogonal said base plane, each of said wall panel members being positionally located in abutting relation to a next successive wall panel member, said wall panel members having a wall panel frame member including a pair of opposing side wall panel frame members extending in a substantially orthogonal direction to said base plane, said opposing side wall panel frame members defining a first side wall panel member having at least one conically tapered slip pin member fixedly secured thereto extending in a direction substantially parallel said base plane and a second side wall panel member having at least one correspondingly conically tapered opening formed therethrough, said conically tapered opening being alignable with said conical slip pin member formed on said first side wall panel member of a next successive wall panel frame member for frictional engagement between said slip pin member and said conical opening; and, (d) a plurality of ceiling panel members secured to said wall panel members, said ceiling panel members extending substantially in a plane parallel said base plane.

2. The modular building structure as recited in claim 1 wherein said wall panel frame member is substantially rectangular in contour adapted for slidable insert into said channel member.

3. The modular building structure as recited in claim 2 where said wall panel frame member includes:

a pair of opposing base wall panel frame members secured to said side wall panel frame members, one of said base wall panel frame members being slidably insertable within said channel member.

4. The modular building structure as recited in claim 3 where said wall panel frame member includes at least one vertical support member secured on opposing ends thereof to said opposing base wall panel frame members, said vertical support member being positionally located substantially central to said opposing pair of side wall panel frame members.

5. The modular building structure as recited in claim 4 where said wall panel frame member includes at least one horizontal support member secured to said vertical support member and said opposing side wall panel frame members.

6. The modular building structure as recited in claim 1 where said ceiling panel member includes a ceiling panel frame member being substantially rectangular in contour adapted for securement to said wall panel members on an upper surface thereof.

7. The modular building structure as recited in claim 6 where said ceiling panel frame member includes:

(a) a pair of opposing side ceiling panel frame members extending in a plane substantially parallel said base plane; and, (b) a pair of opposing base ceiling panel frame members secured to said side ceiling panel frame members, said base ceiling panel frame members being secured to an upper surface of said wall panel members.

8. The modular building structure as recited in claim 7 where said ceiling panel frame member includes at least a pair of orthogonally secured ceiling support frame members secured to said side ceiling panel frame members and said base ceiling panel frame members.

9. The modular building structure as recited in claim 3 including at least one tension rod member extending in a horizontal direction through openings formed in said side wall panel frame members for rigidly securing one wall panel frame member to a next succeeding wall panel frame member.

10. A modular building structure as recited in claim 3 where said wall panel member includes an interior wall panel member secured in rigid manner to said side wall panel frame members and said base wall panel frame members to provide a continuous inner wall of said structure.

11. The modular building structure as recited in claim 10 where said interior wall panel member includes:

(a) a planar wood member; and, (b) a pair of plastic planar members secured to opposing sides of said wood member, said wood member being sandwiched between said plastic planar members.

12. The modular building structure as recited in claim 11 where said interior wall panel member is adhesively secured to said wall panel frame member.

13. The modular building structure as recited in claim 12 including spline means insertable within a groove formed within a peripheral surface of said planar wood member for securement of said interior wall panel member to said wall panel frame member.

14. The modular building structure as recited in claim 3 where said base wall panel frame member is secured to said channel means and said foundation member.

15. The modular building structure as recited in claim 14 including leveling bolt means for securing said base wall panel frame member to said channel member and said foundation member.

16. The modular building structure as recited in claim 1 including floor means positionally located on said foundation member, said floor means extending in said base plane and formed of a plurality of floor panel members.

17. The modular building structure as recited in claim 16 where said floor panel members include:

(a) a floor panel interior planar member; and, (b) a floor panel sub-surface planar member secured to said floor panel interior planar member and mounted on said foundation member.

18. The modular building structure as recited in claim 17 where said floor panel interior planar member is formed of hardwood.

19. The modular building structure as recited in claim 18 where said floor panel sub-surface planar member is formed of plywood.

20. The modular building structure as recited in claim 16 where said floor panel members include:

(a) a floor panel interior planar member;

(b) a floor panel sub-surface planar member secured to said floor panel interior planar member; and, (c) gasket means secured to said floor panel sub-surface planar member and mounted on said foundation member.

21. The modular building structure as recited in claim 20 where said gasket means is resilient in composition formation.

22. The modular building structure as recited in claim 21 where said gasket means is formed of neoprene.

* * * * *